US009474391B2

(12) United States Patent
Leyden et al.

(10) Patent No.: US 9,474,391 B2
(45) Date of Patent: Oct. 25, 2016

(54) DISPLAY STAND FOR PORTABLE ARTICLE

(71) Applicant: Se-Kure Controls, Inc., Franklin Park, IL (US)

(72) Inventors: Roger J. Leyden, Inverness, IL (US); Michael E. Pawelek, Elmhurst, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 118 days.

(21) Appl. No.: 14/025,255

(22) Filed: Sep. 12, 2013

(65) Prior Publication Data

US 2015/0069201 A1 Mar. 12, 2015

(51) Int. Cl.

| | |
|---|---|
| ***A47B 91/00*** | (2006.01) |
| ***A47G 29/00*** | (2006.01) |
| ***B65D 19/00*** | (2006.01) |
| ***A47F 7/024*** | (2006.01) |

(52) U.S. Cl.

CPC ..... *A47F 7/024* (2013.01)

(58) Field of Classification Search

CPC ..... A47F 7/285; A47F 7/286; B65H 75/486; F16M 11/00; F16M 11/04; F16M 11/10; F16M 13/00; F16M 13/02; F16M 2200/00; F16M 2200/08; E06B 9/50

See application file for complete search history.

(56) References Cited

U.S. PATENT DOCUMENTS

| | | | | |
|---|---|---|---|---|
| 4,086,795 | A * | 5/1978 | Foster et al. | 70/233 |
| 7,053,774 | B2 * | 5/2006 | Sedon et al. | 340/568.2 |
| 7,154,039 | B1 * | 12/2006 | Marszalek et al. | 174/50 |
| 7,287,652 | B2 * | 10/2007 | Scholen et al. | 211/26 |
| 7,714,722 | B2 * | 5/2010 | Marszalek et al. | 340/568.2 |
| 2002/0088891 | A1 * | 7/2002 | Liao | 242/378.1 |
| 2005/0040949 | A1 * | 2/2005 | Frederiksen et al. | 340/568.2 |
| 2005/0073413 | A1 * | 4/2005 | Sedon et al. | 340/568.8 |
| 2007/0007379 | A1 * | 1/2007 | Leyden et al. | 242/371 |
| 2012/0097626 | A1 * | 4/2012 | Deguglimo et al. | 211/59.2 |
| 2013/0058516 | A1 * | 3/2013 | Sullivan et al. | 381/380 |

* cited by examiner

*Primary Examiner* — Brian Mattei

(74) *Attorney, Agent, or Firm* — Wood, Phillips, Katz, Clark & Mortimer

(57) ABSTRACT

A display stand for a portable article with a base having a bottom bearing portion and a support for a portable article. A retracting mechanism has a spool around which a flexible tether is wrapped. The spool has an axis around which the spool is turned as the tether is: a) paid out to allow a portable article to which the first end of the tether is connected to be moved away from the base; and b) retracted to shorten a paid out length of the tether. The retracting mechanism has a biasing assembly that urges the spool to turn around the spool axis so as to retract the tether. The tether is guided to be paid out from the spool generally in a straight path in a line, with the line of the straight path transverse to the spool axis.

21 Claims, 4 Drawing Sheets

DISPLAY STAND FOR PORTABLE ARTICLE

BACKGROUND OF THE INVENTION

1. Field of the Invention

This invention relates to display stands as for point-of-purchase locations and, more particularly, to a display stand for portable articles that allows the portable articles to be repositioned within a controlled range.

2. Background Art

Myriad designs currently exist for displaying portable articles at retail point-of-purchase locations. Given the increasingly competitive nature of the retail sales environment, with competition coming from purveyors displaying their wares both in stores and online, the need to present products to gain the attention of consumers has become even more compelling.

The range of portable articles displayed in retail establishments is vast. To differentiate shopping "in stores" versus online, retailers have had to cater to consumers' interest in physically handling, and potentially operating or experiencing, individual products that they are considering purchasing.

With the "hands on" presentation of merchandise comes the inevitable rash of thefts. While articles displayed may be very small, they oftentimes are nonetheless expensive to the level that they warrant investment in security measures.

For example, fragrances, such as perfumes and colognes, may be expensive even in small quantities. Potential purchasers generally wish to pick up a fragrance container and discharge the contents to experience scents before a commitment to purchase is made.

It is known to provide stands for such fragrance containers which have a housing that contains a retractable tether. The tether end is suitably secured to the article such that extension of the tether allows the product to be manipulated within a controlled range dictated by the tether length. By retracting the tether, the container can be re-seated upon the stand.

Heretofore, tether retracting mechanisms have been made with a principal design focus of fitting the same within the dimensional constraints of a base component on the stand. Typically, the stands are made with a height of less than 2 inches so that when they are secured to a subjacent support, they make an article stand out but do not project vertically to the point that they are obtrusive. Further, the footprint of the stand must be controlled to make its use practical.

Heretofore, tether retracting mechanisms have been utilized which, while technically functional, are often prone to failure and may not be commercially feasible because their operation is not smooth, consistent, and reliable. In large part, the shortcomings, some of which are described below, result from the adaptation of the retracting mechanisms to a desired base shape and size.

Binding of the tether may cause a number of different, undesirable results. First, binding may inhibit full retraction. When this condition occurs, the containers may be laid down by a potential consumer wherever a space is found. This contributes to unsightliness of the display area and also introduces the possibility that the container may become situated so that its contents spill.

Second, if the tether binds upon being withdrawn, the potential consumer generally will either: a) exert a substantial force that either causes the article to separate from the restraint or the system to be damaged; or b) abandon the inspection process for that particular product.

Third, in the event that the use of the security systems is considered by the persons in charge of security to be in any way difficult or detrimental, a decision may be made to abandon the use of the security systems. The result may be to not only waste an investment, but also present the products in a manner whereby they are able to be fairly easily absconded with, given their often compact size.

The industry continues to seek out display stands of the type discussed to present a visually attractive display for potential consumers upon which articles are secured against theft through a reasonable investment of resources. The retail industry continues to seek out security systems that will protect product investment and at the same time allow retailers to maintain pricing competitive with other purveyors, including those offering their wares online.

SUMMARY OF THE INVENTION

In one form, the invention is directed to a display stand for a portable article. The display stand includes a base having a bottom bearing portion for placement against a subjacent support to maintain the display stand in an operative position. The base defines a support for a portable article. An elongate flexible tether has a first end for connection to a portable article. A retracting mechanism has a spool around which the tether is wrapped. The spool has an axis around which the spool is turned as the tether is: a) paid out to allow a portable article to which the first end of the tether is connected to be moved away from the base; and b) retracted to shorten a paid out length of the tether to situate a portable article to which the first end of the tether is connected closer to the base. The retracting mechanism has a biasing assembly that urges the spool to turn around the spool axis so as to retract the tether. The tether is guided to be paid out from the spool generally in a straight path in a line transverse to the spool axis.

In one form, the base has a top and a bottom. The support on the base is an upwardly facing surface at the top of the base.

In one form, the retracting mechanism has a housing that defines a space within which the spool resides.

In one form, the base has a chamber within which the housing resides.

In one form, the base has facing surfaces through which the spool axis extends and which confine movement of the housing within the space in opposite directions along the axis of the spool.

In one form, the housing has a width along the spool axis and a length transverse to, and greater than, the width.

In one form, the housing has first and second lengthwise ends. The housing has an opening at the first housing end through which the tether projects from within the housing space.

In one form, the biasing assembly includes an elongate spring element that is wrapped around the spool axis and around a second axis that is generally parallel to the spool axis and spaced between the spool axis and the second end of the housing.

In one form, the opening is located so that the tether projects from the spool generally tangentially.

In one form, the base has a receptacle for the housing into which the housing is press fit into an operative position. The housing in the operative position tends to pivot within the receptacle as the tether is paid out. The base further includes a bottom wall that abuts to the housing to confine pivoting movement of the housing.

In one form, the receptacle is bounded by a top wall. The housing is blocked in the receptacle cooperatively by the top and bottom walls and the facing surfaces and is not otherwise fixed to the base.

In one form, the top wall has an exposed, upwardly facing surface on the base.

In one form, the tether extends from the housing through the upwardly facing surface on the base.

In one form, the housing has a height that is greater than the width but less than the length of the housing.

In one form, the receptacle has a volume that is substantially less than a volume of the chamber defined by the base.

In one form, the upwardly facing surface is substantially flat. The tether has an end fitting for connection to a portable article. There is a recess formed at the upwardly facing surface to receive a part of the end fitting.

In one form, the end fitting has a body with a post that blends into a pad with oppositely facing first and second flat surfaces. The first flat pad surface engages a portable article. The post resides at least partially in the recess.

In one form, the recess has a stepped diameter with a larger diameter portion bounded by an upwardly facing seating surface and with the tether retracted the second flat pad surface facially abuts to the second flat pad surface.

In one form, the display stand is provided in combination with a portable article to which the first end of the tether is connected.

In one form, the base has a peripheral wall upon which information relating to the portable article is applied.

DETAILED DESCRIPTION OF THE PREFERRED EMBODIMENT

Figure 1:
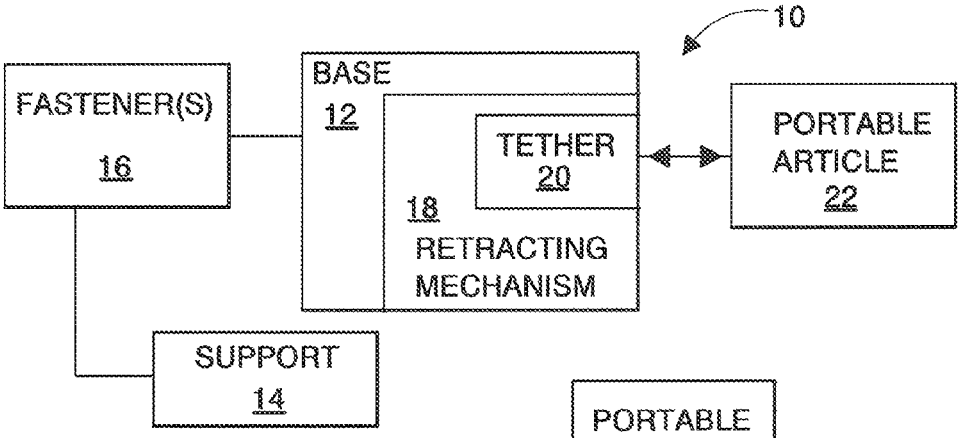
FIG. 1 is a schematic representation of a display stand, according to the present invention.
Figure 2:
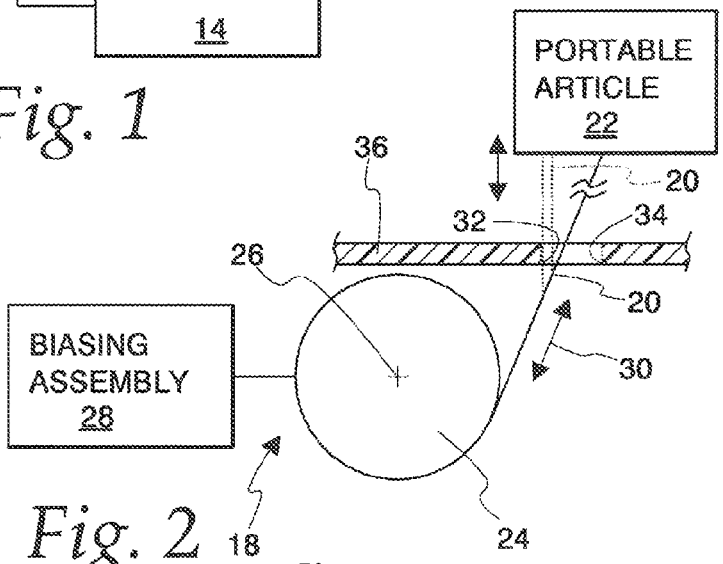
FIG. 2 is a partially schematic representation of a part of the display stand, shown in FIG. 1.
Figure 3:
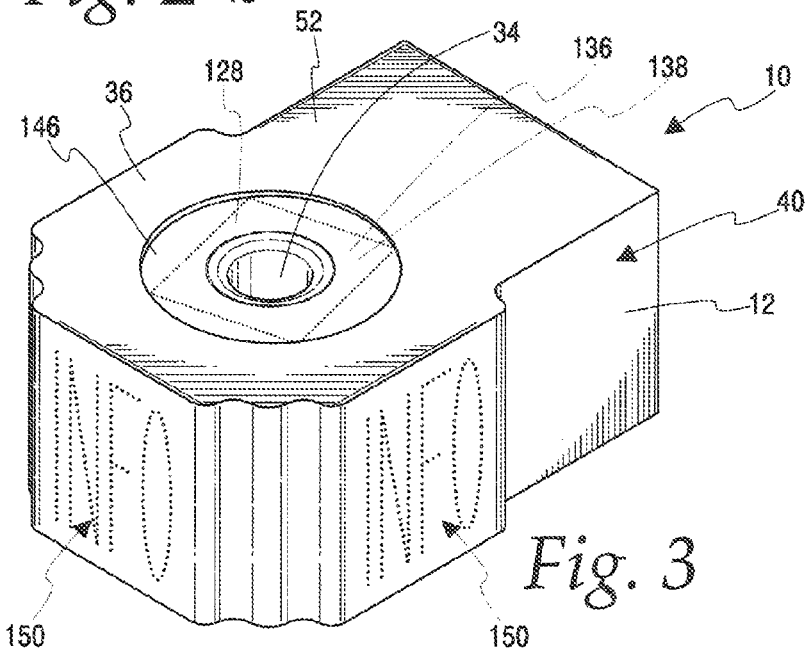
FIG. 3 is a perspective view of one specific form of display stand, as shown schematically in FIGS. 1 and 2.
Figure 4:
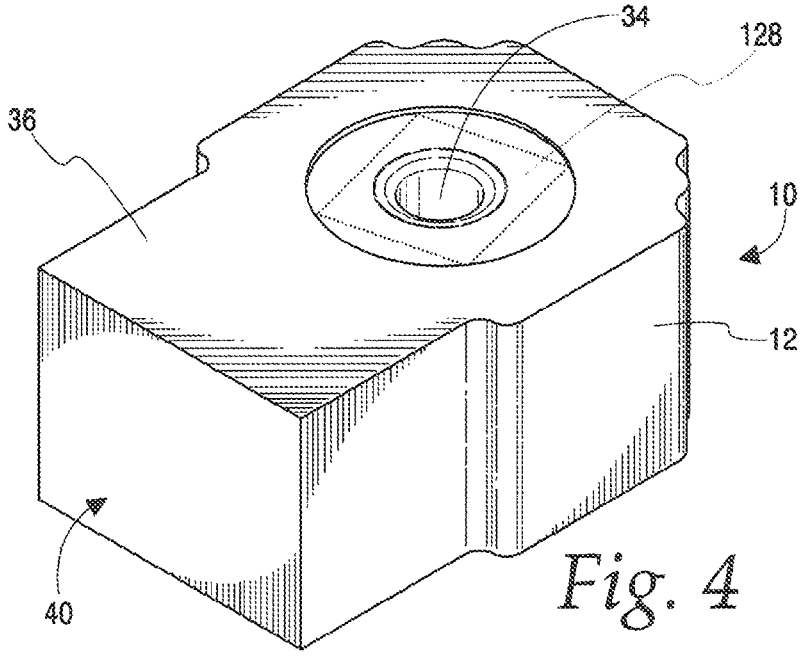
FIG. 4 is a view as in FIG. 3 from another perspective.

In FIGS. 1 and 2, a schematic representation of a display stand, according to the invention, is shown at 10. The display stand 10 can be used at any location where a portable article is to be exhibited in a manner whereby it can be handled and repositioned within a confined range. The display stand 10 consists of a base 12 that can be secured to a support 14 by one or more fasteners 16. The base 12 has a retracting mechanism 18 associated therewith for an elongate, flexible tether 20 that is attached to the portable article 22.

The retracting mechanism 18 consists of a spool 24 that turns around an axis 26. As the spool 24 is turned in one direction, as under a tensile force applied to the tether 20 through the portable article 22, the tether 20 is paid off of the spool 24 to allow the portable article 22 to be moved away from the base 12. By turning the spool 24 oppositely, the tether 20 is wrapped around the spool 24 to shorten a paid out length thereof to situate the portable article 22 closer to the base 12. A biasing assembly 28, that is part of the retracting mechanism 18, normally urges the spool 24 to turn around the axis 26 so as to retract the tether 22.

The components are configured so that the tether 20 is guided to be paid out from the spool 24 generally in a straight line path, indicated by the double-headed arrow 30, from a location where the tether departs from the spool 24 up to an end fitting that connects the end of the tether 20 to the portable article 22. The line of the path is transverse to the spool axis 26 and preferably tangential to the spool 24. The tangential direction is actually in relationship to a circle, centered on the axis 26, at a diameter from which the tether 22 departs the spool 24. The tether 22 can be tensioned in a straight line fully between the spool 24 and portable article 22, or may be redirected at an intermediate length location, as by an edge 32 of an opening 34 in a wall 36 through which the tether 20 projects between the spool 24 and portable article 22. With this arrangement, the tether 20 does not tend to bind with, or twist relative to, the spool 24.

The components in FIGS. 1 and 2 are shown schematically to encompass the specific configurations thereof shown for the embodiment described hereinbelow, and variations thereof. Each of the components could have a significantly different configuration without departing from the invention.

One specific form of display stand 10, according to the present invention, will be described below with reference to FIGS. 3-14. The base 12 has a generally cup-shaped body 38 bounded by a peripheral wall 40 and a top wall 36. The peripheral wall 40 and top wall 36 bound a chamber 44. The chamber 44 could be left open but is, in the preferred embodiment, closed by a bottom wall/cover 46 that is suitably secured at the bottom edge 48 of the peripheral wall 40.

Figure 5:
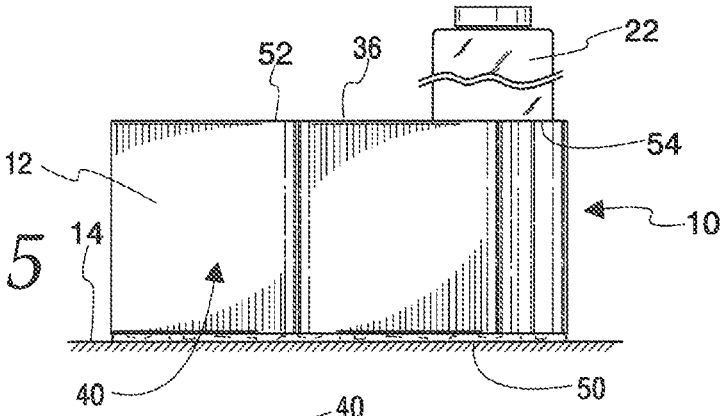
FIG. 5 is a side elevation view of the display stand in FIGS. 3 and 4 and with a portable article displayed thereon.
Figure 6:
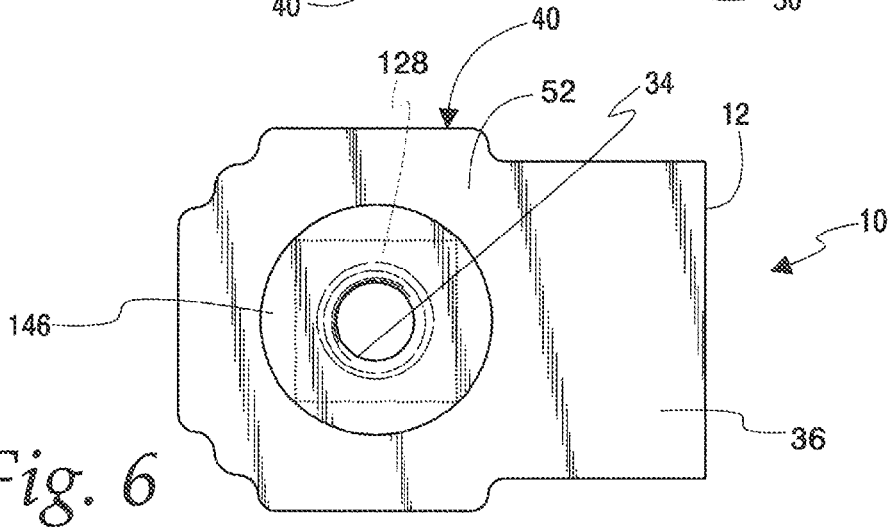
FIG. 6 is a plan view of the display stand in FIGS. 3-5.
Figure 8:
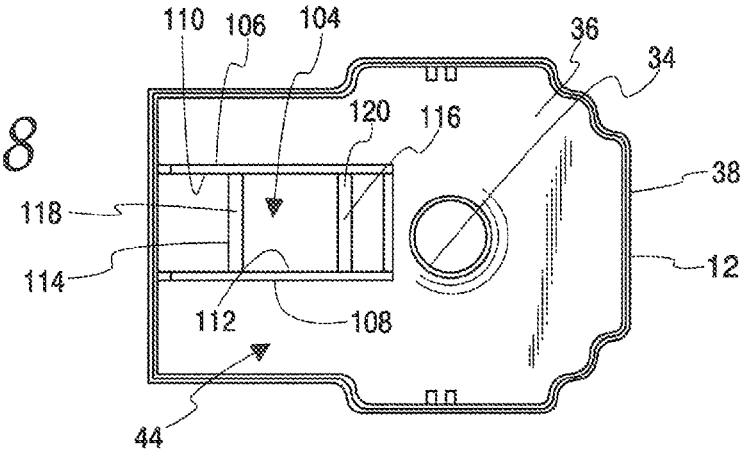
FIG. 8 is a bottom view of a body on the display stand in FIGS. 3-7 with a cover removed.

The bottom wall 46 and/or bottom edge 48 define a bearing portion for placement against the subjacent support 14 to thereby maintain the display stand 10 in an operative position. Securement may be effected as by using a double-sided adhesive 50, or by other well known means. An upwardly facing surface 52 on the top wall 36 defines a support for the portable article 22. While the surface 52 is shown to be flat, the configuration thereof could be varied depending upon the nature of the portable article 22. Typically, the portable article 22 will have a flat surface 54, as indicated in FIG. 5, that can be placed facially against the base surface 52.

The biasing assembly 28 and the spool 24 collectively define the retracting mechanism 18 for the tether 20. A housing 56 defines a space 58 within which the spool 24 and biasing assembly 28 reside.

The depicted housing 56 has a two-part construction with a main, cup-shaped part 60 and a cooperating cover part 62. With the housing 56 assembled, the housing 56 has a length L between first and second ends 64, 66, a width W, and a height H. In this embodiment, the height H is greater than the width W but less than the length L. The housing 56 tapers towards each of the ends 64, 66 to provide a more streamlined shape and control the amount of material required to produce the housing 56.

The spool 24 resides approximately mid-way between the housing ends 64, 66. The spool 24 has a body 68 with a throughbore 70. Stub shafts 72, 74 project towards each other in the same line from the housing parts 60, 62, respectively. With the housing parts 60, 62 joined, the stub shafts 72, 74 project oppositely into the throughbore 70 on the spool 24 to cooperatively mount the spool 24 for turning around the axis 26.

The spool 24 has axially spaced flanges 76, 78 that bound a storage space 80 for the tether 20 that wraps around a core 82. The core 82 extends to beyond the flange 78 to define a support 84 for coils 86 on an elongate spring element 88 that makes up part of the biasing assembly 28.

The elongate spring element 88 spans to a separate stub shaft 90 on the cover part 62, between the spool 24 and housing end 66, around which the spring element 88 is wrapped. This configuration that defines the biasing assembly 28 is used commonly for biasing a turned component. It suffices to say that the elongate spring element 88 is reconfigured to wrap progressively around the support 84 or stub shaft 90, having an axis 91, depending upon the direction of turning of the spool 24. Turning of the spool 24 to effect payout of the tether 20 redistributes the spring turns/coils 86 to thereby generate an increasing biasing force on the spool 24 that tends to rotate it oppositely so as to retract the tether 20.

Figure 10:
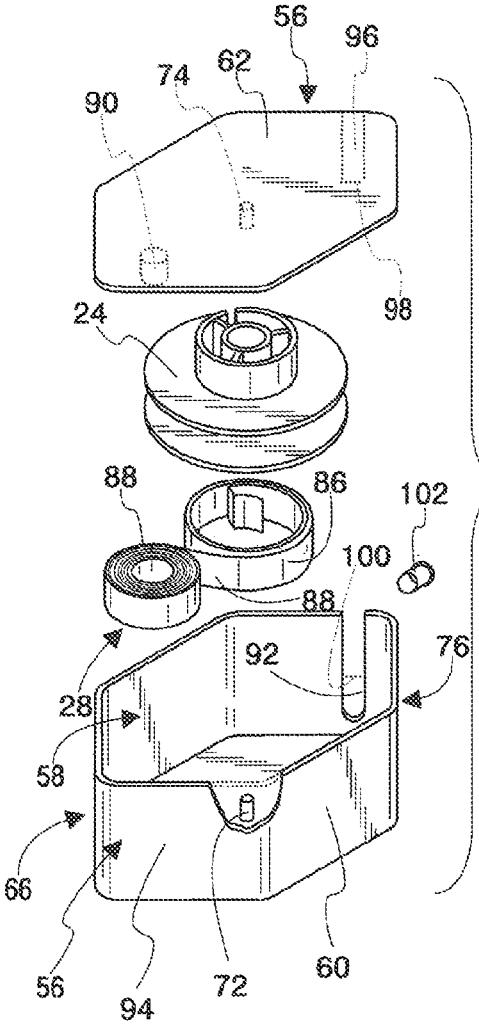
FIG. 10 is an enlarged, exploded, perspective view of the housing in FIG. 9.

The tether 20 departs from the space 58 through an opening 92. The opening 92 is defined in a peripheral wall 94 of the housing part 60. For purposes of convenience of manufacture and assembly, the opening 92 is made over a majority of the width W of the housing 56. The cover part 62 has a projecting blocking element 96 that slides into the opening 92 so as to thereby block the tether 20 in the opening 92. As seen in FIG. 10, the bottom 98 of the blocking element 96 extends to the location of the dotted line 100 whereby the fully surrounded opening portion will accept a guide collar 102 that becomes captively held. The guide collar 102 can be made from metal, thereby allowing the housing parts 60, 62 to be made from a plastic material, or the like, without concern about abrasive wear from repetitive contact with the tether 20.

The base 12 defines a receptacle 104 within the chamber 44 for receiving the housing 56. The volume of the receptacle 104 is substantially less than the volume of the chamber 44. The receptacle 104 is bounded by spaced flat walls 106, 108 with facing surfaces 110, 112 through which the spool axis 26 extends and which confine movement of the housing within the receptacle 104 in opposite directions along the axis 26 of the spool 24. Preferably, the surfaces 110, 112 are spaced a distance slightly greater than the housing width W, so that the housing 56 can be press-fit into an operative position without any significant resistance. A pair of support components 114, 116 on the top wall 36 define edges 118, 120, respectively, that bear against the spanning housing 56.

Figure 9:
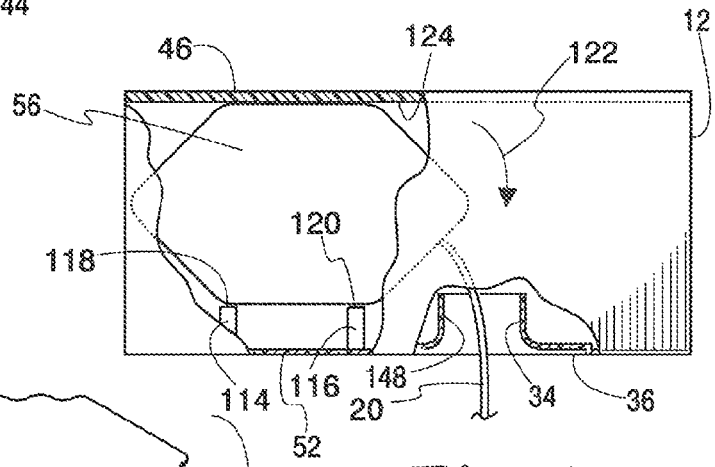
FIG. 9 is a side elevation view of the display stand in FIGS. 3-8 partially broken away to expose a housing for a retracting mechanism for a flexible tether which attaches to a portable article being displayed.
Figure 7:
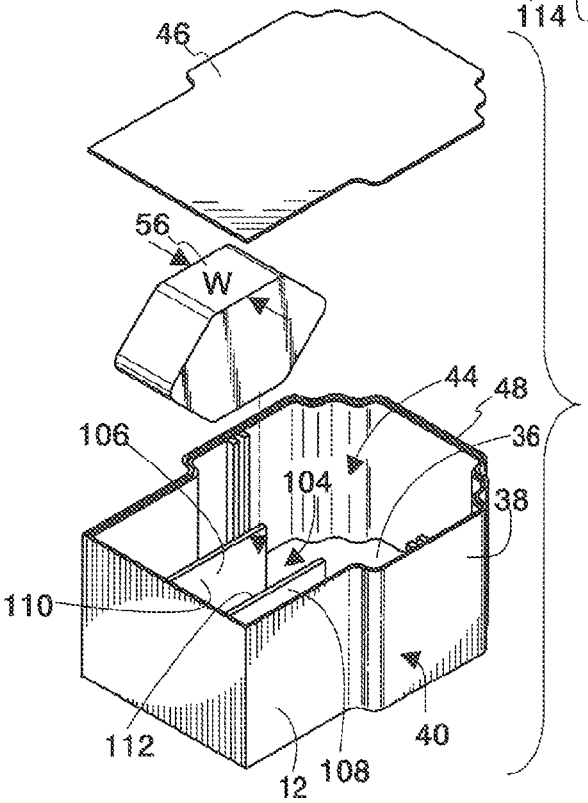
FIG. 7 is a reduced, exploded, bottom, perspective view of the display stand in FIGS. 3-6.
Figure 11:
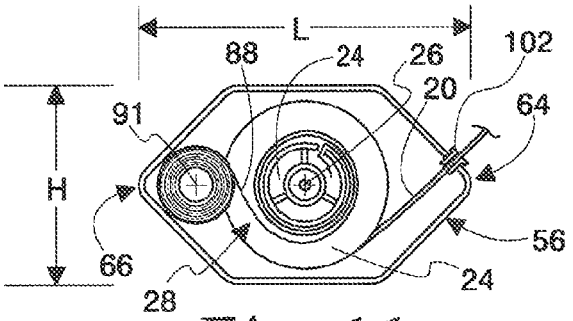
FIG. 11 is a side elevation view of the housing in FIG. 10 with a cover part removed therefrom.
Figure 12:
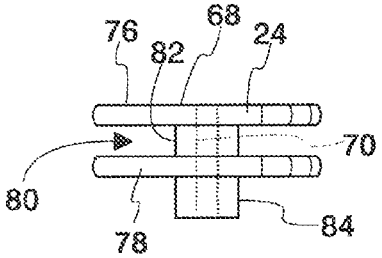
FIG. 12 is an enlarged, side elevation view of a spool that is part of the retracting mechanism for the tether.

With this arrangement, as seen in FIG. 9, tension application upon the tether 20 produces a force on the housing 56 that tends to pivot the housing 56 generally in the direction of the arrow 122. This pivoting action is blocked/confined by the bottom base wall 46 that has a substantially flat surface 124 that abuts to a substantially flat surface on the bottom of the housing 56. The base top wall 36 and bottom wall 46 are configured so that with the housing 56 operatively press fit, the flat housing and base surfaces are maintained in a facing relationship wherein they cooperate to block/confine this pivoting action. With this arrangement, the housing 56 is blocked in the receptacle 104 between the support components 114, 116 on the top wall 36 and the bottom wall 46 in a manner that it does not require any other structure, such as fasteners, etc., to be fixed to the base 12.

The tether 20 extends through an opening 34 in the top wall 36 and thus through the upwardly facing surface 52 defined thereby. The upwardly facing surface 52 is substantially flat. The opening 34 has a stepped diameter to accommodate an end fitting 128 that connects to the free end 130 of the tether 20 and is attachable to the portable article 22 thereby to secure the free tether end 130 thereto. The stepped configuration of the opening 34 defines a recess through the upwardly facing surface 52 to receive part or all of the end fitting 128, shown in FIG. 14 to extend fully through the top wall 36. As seen in FIG. 9, the tether 20 is capable of projecting in a substantially straight line, from a location at which it departs from the housing 56, for one article position, generally orthogonally to the plane of the surface 52 from the chamber 44 up to the end fitting 128 connected to the article 22.

Figure 14:
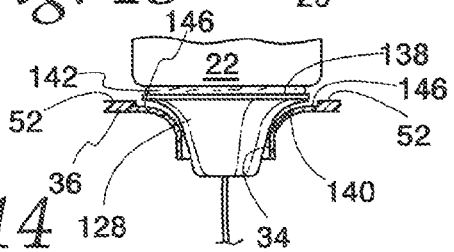
FIG. 14 is a fragmentary elevation view of the end fitting in FIG. 13 and stored in a recess in a wall of the body on the display stand.

The end fitting 128 has a body 132 with a post 134 that blends into a pad 136. The pad 136 has oppositely facing flat surfaces 138, 140. The surface 138 directly or indirectly engages the portable article 22. In FIG. 14, a double-sided adhesive layer 142 is utilized to effect connection between the end fitting 128 and portable article 22.

Figure 13:
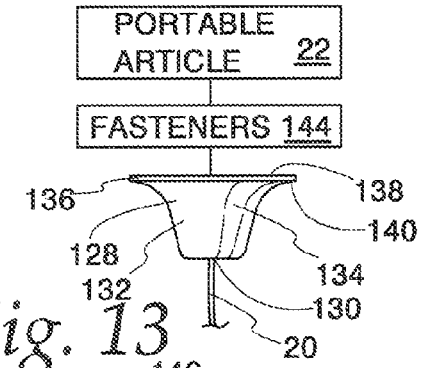
FIG. 13 is a partially schematic representation of an end fitting on the tether connected to a portable article.

The connection between the end fitting 128 and portable article 22 is shown more generically in FIG. 13 to encompass any type of fastener or fasteners 144 commonly used by those in this art.

The opening 34 is configured such that the surface 140 nests against an annular, recessed, step 146 so that the surface 138 is substantially flush with the wall surface 52. The opening 34 has a reduced diameter portion 148 that nominally matches the shape of the body 132, which may be slightly tapered to facilitate its guided introduction into the opening 34.

The peripheral wall 40 has an irregular shape dictated by aesthetics. An exposed surface thereon lends itself to the placement of information, shown generically at 150, that may relate to the displayed article. The information may be an identification of the article, a trademark or logo, or other information identifying, or describing attributes of, the article, or its supplier/manufacturer.

The foregoing disclosure of specific embodiments is intended to be illustrative of the broad concepts comprehended by the invention.

The invention claimed is:

1. A display stand for a portable article, the display stand comprising:

a base having a top and bottom and a bottom bearing portion for placement against a subjacent support to maintain the display stand in an operative position, the base defining an upwardly facing support surface against which the portable article is placed to be displayed;

an elongate flexible tether having a first end with an end fitting for connection of the first tether end to a portable article; and a retracting mechanism comprising a spool around which the tether is wrapped, the retracting mechanism comprising a housing defining a space within which the spool resides, the spool having an axis around which the spool is turned as the tether is: a) paid out to allow a portable article to which the first end of the tether is connected to be moved away from the base; and b) retracted to shorten a paid out length of the tether to situate a portable article to which the first end of the tether is connected closer to the base, the retracting mechanism comprising a biasing assembly that urges the spool to turn around the spool axis so as to retract the tether, the base and retracting mechanism configured so that the tether is guided to be paid out from the spool in a path in a substantially straight line extending from a location where the tether departs from the housing up to the end fitting at the first end of the tether with the end fitting connected to a portable article to be displayed, the line of the straight path transverse to the spool axis, wherein the tether extends from the housing through the upwardly facing support surface on the base, wherein the base comprises a body that defines a receptacle for the housing into which the housing is press fit into an operative position, the operatively positioned housing and base configured so that: a) the housing is confined by facing surfaces on the base spaced along the spool axis between which the housing resides; and b) the housing abuts to the base to confine pivoting of the housing relative to the base under forces imparted to the housing as an incident of the tether being paid out.

2. The display stand according to claim 1 wherein the base defines a chamber within which the receptacle is formed.

3. The display stand according to claim 2 wherein the spool axis extends through the facing surfaces of the base.

4. The display stand according to claim 3 wherein the housing has a width along the spool axis and a length transverse to, and greater than, the width.

5. The display stand according to claim 4 wherein the housing has first and second lengthwise ends and the housing has an opening at the first housing end through which the tether projects from within the housing space.

6. The display stand according to claim 5 wherein the biasing assembly comprises an elongate spring element that is wrapped around the spool axis and around a second axis that is generally parallel to the spool axis and spaced between the spool axis and the second end of the housing.

7. The display stand according to claim 5 wherein the opening is located so that the tether projects from the spool generally tangentially.

8. The display stand according to claim 5 wherein the base further comprises a bottom wall that abuts to the housing to confine pivoting movement of the housing.

9. The display stand according to claim 8 wherein the receptacle is bounded by a top wall and the housing is blocked in the receptacle cooperatively by the top and bottom walls and the facing surfaces and is not otherwise fixed to the base.

10. The display stand according to claim 9 wherein the top wall defines the upwardly facing support surface on the base.

11. The display stand according to claim 8 wherein the receptacle has a volume that is substantially less than a volume of the chamber defined by the base.

12. The display stand according to claim 4 wherein the housing has a height that is greater than the width but less than the length of the housing.

13. The display stand according to claim 1 wherein the upwardly facing surface is substantially flat, the tether has an end fitting for connection to a portable article and there is a recess formed at the upwardly facing surface to receive a part of the end fitting.

14. The display stand according to claim 13 wherein the end fitting comprises a body with a post that blends into a pad with oppositely facing first and second flat surfaces, the first flat pad surface to engage a portable article, the post residing at least partially in the recess.

15. The display stand according to claim 1 in combination with a portable article to which the first end of the tether is connected.

16. The display stand according to claim 15 wherein the base has a peripheral wall upon which information relating to the portable article is applied.

17. The display stand according to claim 1 wherein the upwardly facing support surface is substantially flat and parallel to a flat surface upon which the base is placed and the base and retracting mechanism are configured so that the tether is capable of projecting from within the housing space through the upwardly facing support surface on the base up to a portable article to which the first end of the tether is connected in a line that is substantially orthogonal to a plane of the upwardly facing support surface with the portable article in a display state.

18. A display stand for a portable article, the display stand comprising:

a base having a bottom bearing portion for placement against a subjacent support to maintain the display stand in an operative position, the base defining a support for the portable article;

an elongate flexible tether having a first end for connection to a portable article; and a retracting mechanism comprising a spool around which the tether is wrapped, the spool having an axis around which the spool is turned as the tether is: a) paid out to allow a portable article to which the first end of the tether is connected to be moved away from the base; and b) retracted to shorten a paid out length of the tether to situate a portable article to which the first end of the tether is connected closer to the base, the retracting mechanism comprising a biasing assembly that urges the spool to turn around the spool axis so as to retract the tether, the tether guided to be paid out from the spool generally in a straight path in a line, the line of the straight path transverse to the spool axis, wherein the retracting mechanism comprises a housing defining a space within which the spool resides, wherein the base defines a chamber within which the housing resides, wherein the base defines facing surfaces through which the spool axis extends and which confine movement of the housing within the space in opposite directions along the axis of the spool, wherein the housing has a width along the spool axis and a length transverse to, and greater than, the width, wherein the housing has first and second lengthwise ends and the housing has an opening at the first housing end through which the tether projects from within the housing space, wherein the base defines a receptacle for the housing into which the housing is press fit into an operative position, the housing in the operative position tending to pivot within the receptacle as the tether is paid out, wherein the base further comprises a bottom wall that abuts to the housing to confine pivoting movement of the housing, wherein the receptacle is bounded by a top wall and the housing is blocked in the receptacle cooperatively by the top and bottom walls and the facing surfaces and is not otherwise fixed to the base, wherein the top wall defines an exposed, upwardly facing surface on the base, wherein the tether extends from the housing through the upwardly facing surface on the base, wherein the upwardly facing surface is substantially flat, the tether has an end fitting for connection to a portable article, and there is a recess formed at the upwardly facing surface to receive a part of the end fitting, wherein the end fitting comprises a body with a post that blends into a pad with oppositely facing first and second flat surfaces, the first flat pad surface to engage a portable article, the post residing at least partially in the recess, wherein the recess has a stepped diameter with a larger diameter portion bounded by an upwardly facing seating surface and with the tether retracted the second flat pad surface abuts to the seating surface.

19. A display stand for a portable article, the display stand comprising:

a base having a top and bottom and a bottom bearing portion for placement against a subjacent support to maintain the display stand in an operative position, the base defining an upwardly facing support surface for the portable article;

an elongate flexible tether having a first end with an end fitting for connection of the first tether end to a portable article; and a retracting mechanism comprising a spool around which the tether is wrapped, the retracting mechanism comprising a housing defining a space within which the spool resides, the spool having an axis around which the spool is turned as the tether is: a) paid out to allow a portable article to which the first end of the tether is connected to be moved away from the base; and b) retracted to shorten a paid out length of the tether to situate a portable article to which the first end of the tether is connected closer to the base, the retracting mechanism comprising a biasing assembly that urges the spool to turn around the spool axis so as to retract the tether, the base and retracting mechanism configured so that the tether is guided to be paid out from the spool generally in a straight path in a line, the line of the straight path transverse to the spool axis, wherein the tether extends from the housing through the upwardly facing support surface on the base, wherein the base comprises a body that defines a receptacle for the housing into which the housing is press fit into an operative position, the operatively positioned housing and base configured so that: a) the housing is confined by facing surfaces on the base spaced along the spool axis between which the housing resides; and b) the housing abuts to the base to confine pivoting of the housing relative to the base under forces imparted to the housing as an incident of the tether being paid out, wherein the upwardly facing surface is substantially flat, the tether has an end fitting for connection to a portable article and there is a recess formed at the upwardly facing surface to receive a part of the end fitting, wherein the end fitting comprises a body with a post that blends into a pad with oppositely facing first and second flat surfaces, the first flat pad surface to engage a portable article, the post residing at least partially in the recess, wherein the recess has a stepped diameter with a larger diameter portion bounded by an upwardly facing seating surface and with the tether retracted the second flat pad surface facially abuts to the seating surface.

20. A display stand for a portable article, the display stand comprising:

a base having a top and bottom and a bottom bearing portion for placement against a subjacent support to maintain the display stand in an operative position, the base defining an upwardly facing support surface for the portable article;

an elongate flexible tether having a first end with an end fitting for connection of the first tether end to a portable article; and a retracting mechanism comprising a spool around which the tether is wrapped, the retracting mechanism comprising a housing defining a space within which the spool resides, the spool having an axis around which the spool is turned as the tether is: a) paid out to allow a portable article to which the first end of the tether is connected to be moved away from the base; and b) retracted to shorten a paid out length of the tether to situate a portable article to which the first end of the tether is connected closer to the base, the retracting mechanism comprising a biasing assembly that urges the spool to turn around the spool axis so as to retract the tether, the base and retracting mechanism configured so that the tether is guided to be paid out from the spool generally in a straight path in a line, the line of the straight path transverse to the spool axis, wherein the tether extends from the housing through the upwardly facing support surface on the base, wherein the base comprises a body that defines a receptacle for the housing into which the housing is press fit into an operative position, the operatively positioned housing and base configured so that: a) the housing is confined by facing surfaces on the base spaced along the spool axis between which the housing resides; and b) the housing abuts to the base to confine pivoting of the housing relative to the base under forces imparted to the housing as an incident of the tether being paid out, wherein the receptacle is bounded by a top wall on which the upwardly facing support surface is formed, and the end fitting extends downwardly fully through the top wall and into the receptacle.

21. A display stand for a portable article, the display stand comprising:

a base having a top and bottom and a bottom bearing portion for placement against a subjacent support to maintain the display stand in an operative position, the base defining an upwardly facing support surface at which the portable article is placed to be displayed;

an elongate flexible tether having a first end with an end fitting for connection of the first tether end to a portable article; and a retracting mechanism comprising a spool around which the tether is wrapped, the retracting mechanism comprising a housing defining a space within which the spool resides, the spool having an axis around which the spool is turned as the tether is: a) paid out to allow a portable article to which the first end of the tether is connected to be moved away from the base; and b) refracted to shorten a paid out length of the tether to situate a portable article to which the first end of the tether is connected closer to the base, the retracting mechanism comprising a biasing assembly that urges the spool to turn around the spool axis so as to retract the tether, wherein the tether extends from the housing through the upwardly facing support surface on the base transversely to the spool axis, wherein the base comprises a body that defines a receptacle for the housing into which the housing is press fit into an operative position, the operatively positioned housing and base configured so that: a) the housing is confined between wails in fixed relationship to each other on the base spaced along the spool axis; and b) the housing and base cooperate to confine pivoting of the housing relative to the base under forces imparted to the housing as an incident of the tether being pulled out, wherein the operatively positioned housing has a substantially flat surface that faces a substantially flat surface on the base, wherein the base has facing walls that capture the housing so that the substantially flat surfaces cooperate to confine pivoting of the housing relative to the base under the forces imparted to the housing as an incident of the tether being pulled out of the housing.

* * * * *